US006802590B2

(12) United States Patent
Lim

(10) Patent No.: US 6,802,590 B2
(45) Date of Patent: Oct. 12, 2004

(54) APPARATUS FOR CLEANING PRINT HEAD OF INK JET PRINTER

(75) Inventor: Gui-taek Lim, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 58 days.

(21) Appl. No.: 10/282,197

(22) Filed: Oct. 29, 2002

(65) Prior Publication Data

US 2003/0122892 A1 Jul. 3, 2003

(30) Foreign Application Priority Data

Jan. 2, 2002 (KR) ..... 2002-116

(51) Int. Cl.[7] ..... B41J 2/165
(52) U.S. Cl. ..... 347/33
(58) Field of Search ..... 347/8, 22, 23, 347/29, 30, 33, 32, 37; 400/55, 59

(56) References Cited

U.S. PATENT DOCUMENTS 6,315,468 B2 * 11/2001 Kishida et al. ..... 400/55
6,598,955 B1 * 7/2003 Tee et al. ..... 347/33
6,631,975 B2 * 10/2003 Fukasawa et al. ..... 347/33

FOREIGN PATENT DOCUMENTS

JP 410138500 A * 5/1998

* cited by examiner

*Primary Examiner*—Shih-Wen Hsieh
(74) *Attorney, Agent, or Firm*—Staas & Halsey LLP

(57) ABSTRACT

An apparatus for cleaning a print head in an ink jet printer, in which the print head is disposed under a carriage, includes a movable plate reciprocally sliding under the carriage, a wiper supported by the movable plate to clean the print head in a state that the wiper is overlapped with the print head by a desired height when the wiper is reciprocally moved, a pivot bar pivotally mounted on the movable plate and having one end supporting the wiper, and a driving mechanism adjusting the height of the wiper by driving the pivot bar to pivot such that the overlapping of the wiper relative to the print head is constantly maintained.

23 Claims, 4 Drawing Sheets

APPARATUS FOR CLEANING PRINT HEAD OF INK JET PRINTER

CROSS-REFERENCE TO RELATED APPLICATIONS

This application claims the benefits of Korean Patent Application No. 2002-116, filed Jan. 2, 2002, in the Korean Industrial Property Office, the disclosure of which is incorporated herein by reference.

BACKGROUND OF THE INVENTION

1. Field of the Invention

The present invention relates to an apparatus for cleaning a print head of an ink jet printer, and more particularly, to a cleaning apparatus of a print head capable of maintaining a wiper to overlap the print head by a predetermined area.

2. Description of the Related Art

In general, an ink jet recording apparatus, such as an ink jet printer and an ink jet plotter, includes a carriage reciprocally moving on a main frame, on which an ink cartridge and a print head are mounted. The carriage is movably mounted on a guide shaft. The carriage is also connected to a timing belt that is fitted around a drive pulley coupled to a rotary shaft of a pulse motor. As the motor rotates, the carriage is moved in a main scanning direction relative to a recording sheet. A desired gap is provided between the print head and the recording sheet fed by a sheet-feeding roller. The print head ejects ink droplets upon receipt of drive pulses from a controller to print images on the recording sheet. Specifically, as the print head is reciprocally moved in the main scanning direction, the ink droplets are ejected through an ink spray nozzle of the print head to form the images on the recording sheet. In such an apparatus, an ink spraying operation is properly controlled in accordance with image information inputted from the controller of the ink jet recording apparatus.

With the construction described above, after a printing operation is performed, the ink remains at the ink spray nozzle. In a case that the printer is not used for a relatively longer period, the ink remaining at the ink spray nozzle is solidified. As the ink spray nozzle is partially or wholly clogged with the solidified ink, new ink droplets cannot be ejected in an appropriate amount, and as a result, a printing quality deteriorates.

In addition, the ink spray nozzle may be clogged with an extraneous substance such as dust, thereby exerting an adverse effect on the printing quality. Accordingly, in order to prevent the ink spray nozzle from being clogged, an apparatus for cleaning the print head is required.

FIG. 1 shows a perspective view of a conventional cleaning apparatus of a print head.

Referring to FIG. 1, the cleaning apparatus includes a housing 10 disposed under an ink cartridge 1, a plate 11 slidably moving in the housing 10, and a wiper 13 vertically mounted on an upper portion of the plate 11 by a holder (not shown). The wiper 13 is reciprocally moved by the plate 11 to clean the print head of the ink cartridge 1 positioned at a home (rest) location. Since it is a very important parameter as to how much the wiper 13 overlaps the print head, it is necessary to properly adjust a height of the wiper 13.

Meanwhile, the ink jet printer not only prints on the recording sheet of a standard size paper sheet like A4-sized sheets, but also prints on another recording sheet of a nonstandard size paper sheet like an envelope which is thicker than the standard size paper sheet. When an image is printed on the nonstandard size paper sheet which is relatively thicker, the head gap between the print head and the recording sheet is widened by a head gap adjusting mechanism to maintain the head gap of a predetermined distance.

Since a height of the wiper with respect to the recording sheet is fixed (constant), if the head gap is extended (adjusted), an overlapping area between the wiper and the printer head is reduced. As a result, the cleaning of the print head is not normally performed with the wiper having the reduced overlapping area with the print head, and an image quality deteriorates.

SUMMARY OF THE INVENTION

Accordingly, it is an object of the present invention to provide an apparatus for cleaning a print head of an ink jet printer that substantially obviates the above and other problems due to limitations and disadvantages of the related art It is another object of the present invention to provide an apparatus for cleaning a print head having an improved structure that enables a wiper to overlap the print head by a predetermined area.

Additional objects and advantages of the invention will be set forth in part in the description which follows and, in part, will be obvious from the description, or may be learned by practice of the invention.

According to an embodiment of the invention to solve the above and other objects, there is provided an apparatus for cleaning a print head disposed on a carriage an ink jet printer. The apparatus includes a movable plate reciprocally sliding under the carriage; a wiper, supported by the movable plate to clean the print head in a state that the wiper is overlapped with the print head by a predetermined height when the wiper is reciprocally moved, a pivot bar pivotally mounted to the movable plate and having one end supporting the wiper, and a driving unit adjusting the height of the wiper such that an overlapping amount of the wiper relative to the print head is constantly maintained by the pivot bar pivoting on the movable plate.

According to an aspect of the present invention, the driving unit includes a magnet member movably installed on the movable plate and having one end engaged with the pivot bar, and an electromagnet installed adjacent to the magnet member and disposed at a selected location relative to the magnet member to control the magnet member.

According to another aspect of the present invention, the electromagnet is a criss-cross of electromagnets having a south pole and a north pole being alternated with each other at a right angle, and the criss-cross electromagnets are selectively rotated at a desired angle around a center of the criss-cross electromagnets by a rotating motor.

The driving unit includes a solenoid installed on the movable plate to be cooperated with the another end of the pivot bar to control the pivot bar to move up and down with respect to the print head and pivot on the movable plate.

The apparatus further includes a wiper holder movably installed on the movable plate such that the wiper is lifted by the one end of the pivot bar in a state that the wiper is supported by the wiper holder.

BRIEF DESCRIPTION OF THE DRAWINGS

These and other objects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
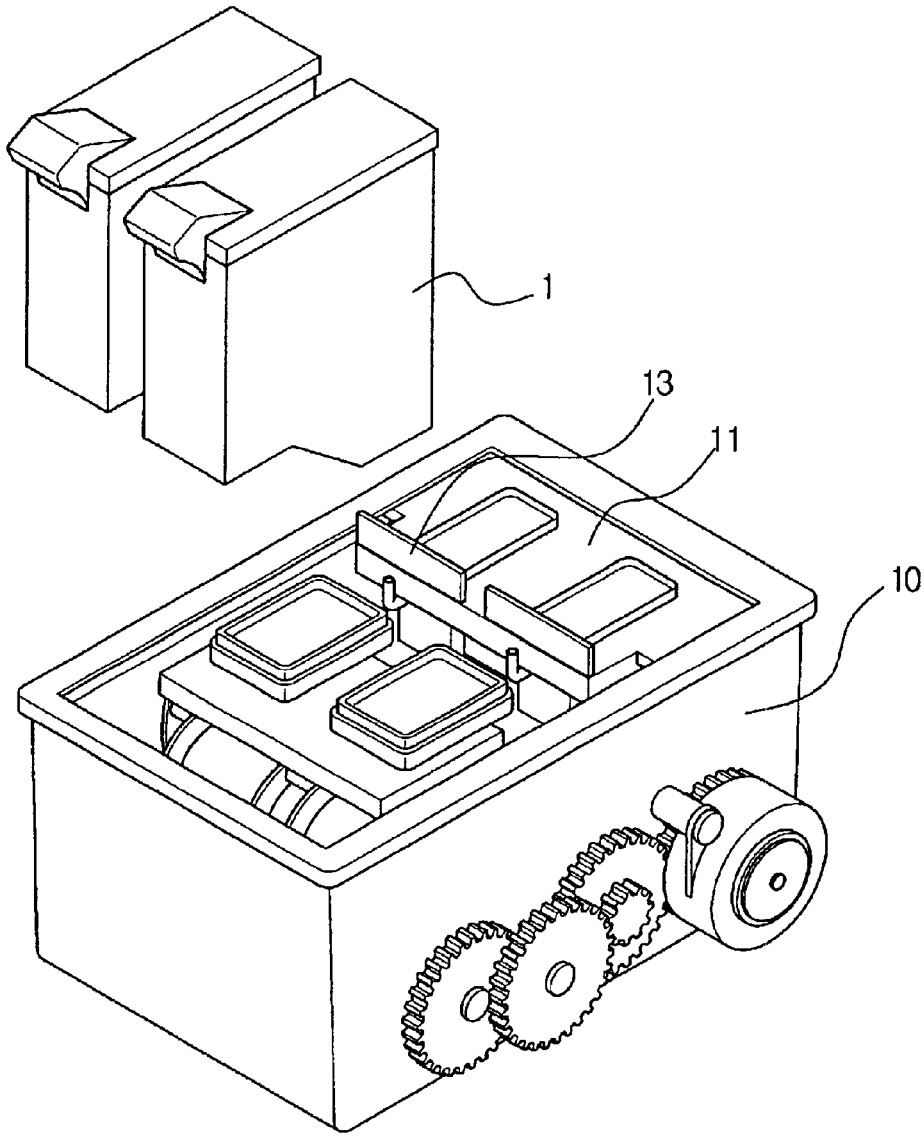
FIG. 1 (PRIOR ART)
FIG. 1 is a perspective view of a conventional cleaning apparatus of a print head in an ink jet printer.

Reference will now be made in detail to the present preferred embodiments of the present invention, examples of which are illustrated in the accompanying drawings, wherein like reference numerals refer to the like elements throughout. The embodiments are described below in order to explain the present invention by referring to the figures.

Figure 2:
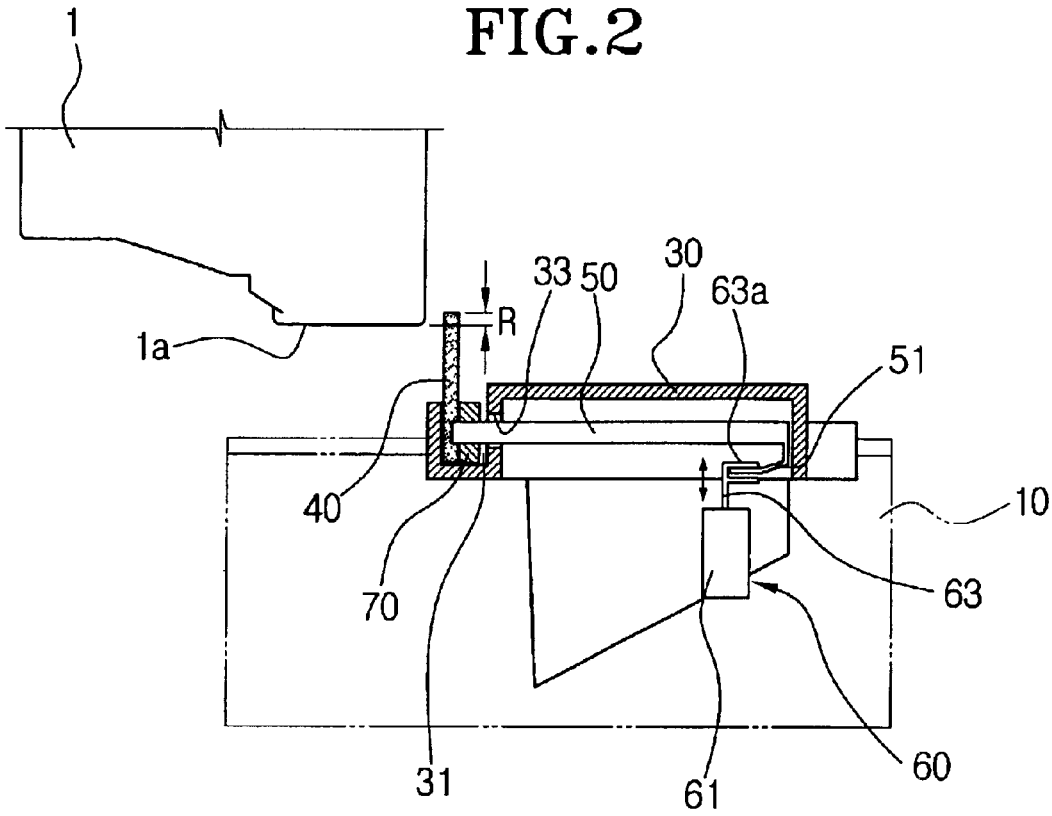
FIG. 2 is a cross sectional view of a cleaning apparatus of a print head in an ink jet printer according to an embodiment of the present invention.

An apparatus for cleaning a print head of an ink jet printer according to an embodiment of the present invention, as shown in FIG. 2, includes a movable plate 30 reciprocally sliding under a carriage 1, a wiper 40, a pivot bar 50 pivotally mounted on the movable plate 30 and having one end supporting the wiper 40, and a driving mechanism selectively driving the pivot bar 50 to pivot on the movable plate 30.

The carriage 1 is reciprocally moved on a main frame of the ink jet printer, on which an ink cartridge and a print head 1*a* ejecting ink droplets are mounted. The carriage 1 is movably mounted on a guide shaft. A desired head gap is provided between the print head 1*a* and a recording sheet that is fed to a printing position (paper feeding path) under the print head. If a heavy grade of the recording sheet such as an envelope is supplied, a thickness of the recording sheet is detected by a head gap detecting sensor so that a height of the carriage 1 is lifted by a lifted distance and adjusted to maintain the head gap constant. The head gap detecting sensor and the head gap adjusting apparatus are widely known, and thus the detail description thereof will be omitted.

The carriage 1 is moved between a printing location in which the carriage 1 is reciprocally moved along a desired distance and ejects the ink droplets on the recording sheet to form an image and a home (rest) location at which the carriage 1 is removed from the printing location and stands by to move into the printing location in response to an input of a printing command. A cleaning operation of the print head 1*a* is performed at the home location by the cleaning apparatus.

The movable plate 30 is slidably mounted in the housing 10 and disposed under the carriage 1 to slide to the left and right. The construction of the movable plate 30 is widely known, and thus the detailed description thereof will be omitted. The movable plate 30 is provided with a receptacle groove 31.

The wiper 40 is movably mounted in the receptacle groove 31 to be raised and lowered with respect to the print head 1*a*. The wiper 40 is installed below the print head in such a manner that it is overlapped with the print head 1*a* by a predetermined height R. A left and right movement of the movable plate 30 causes a surface of the print head 1*a* to be cleaned by an overlapping contact between the wiper 40 and the printer head 1*a*. Preferably, the wiper 40 is made of an elastic deformable material, for example, a rubber material.

The wiper 40 is installed in the receptacle groove 31 while being supported by a wiper holder 70. In other words, the wiper 40 is accommodated in the receptacle groove 31 in a state that it is engaged with or attached to the wiper holder 70, and the wiper 40 and the wiper holder 70 are movably mounted in the receptacle groove 31 in a vertical direction.

The pivot bar 50 is movably disposed on the movable plate 30 so that one end thereof supports the wiper holder 70. The pivot bar 50 is inserted into a supporting hole 33 formed in a supporting plate of the movable plate 30, and pivots left and right with respect to the supporting plate. Specifically, the pivot bar 50 can be moved left and right (up and down) in the supporting hole with respect to the supporting plate like a seesaw. Accordingly, if another end of the pivot bar 50 is pulled down according to a principal of leverage, the one end is moved upward to lift the wiper 40 by a desired distance. Another end of the pivot bar 50 has an engaging hook 51 connected to the driving mechanism and bent in a desired shape.

The driving mechanism includes a solenoid 60 located under the pivot bar 50 to selectively drive the pivot bar 50 to pivot and be lifted. The solenoid 60 has a driving part 61 and a moving part 63 being moved up and down by the driving part 61 so as to control the pivot bar 50. The moving part 63 is provided with an interfering part 63*a* bent in a desired shape to engage the engaging hook 51 of the pivot bar 50.

An operation of the cleaning apparatus of the print head in the ink jet printer according to this embodiment of the present invention will now be described.

During printing, the recording sheet is fed under the print head 1*a*, and the head gap is detected. If a relatively thick sheet of paper like an envelope is fed, the head gap is detected as being less than a reference value. The carriage 1 is lifted up by a desired distance in accordance with the detected information of the head gap, thereby adjusting the head gap to the reference value.

Simultaneously, if the carriage 1 is lifted to adjust the head gap, the solenoid 60 is driven in accordance with the detected information. If the moving part 63 is lowered in a desired distance, the engaging hook 51 connected to the interfering part 63*a* is pulled down.

Figure 3:
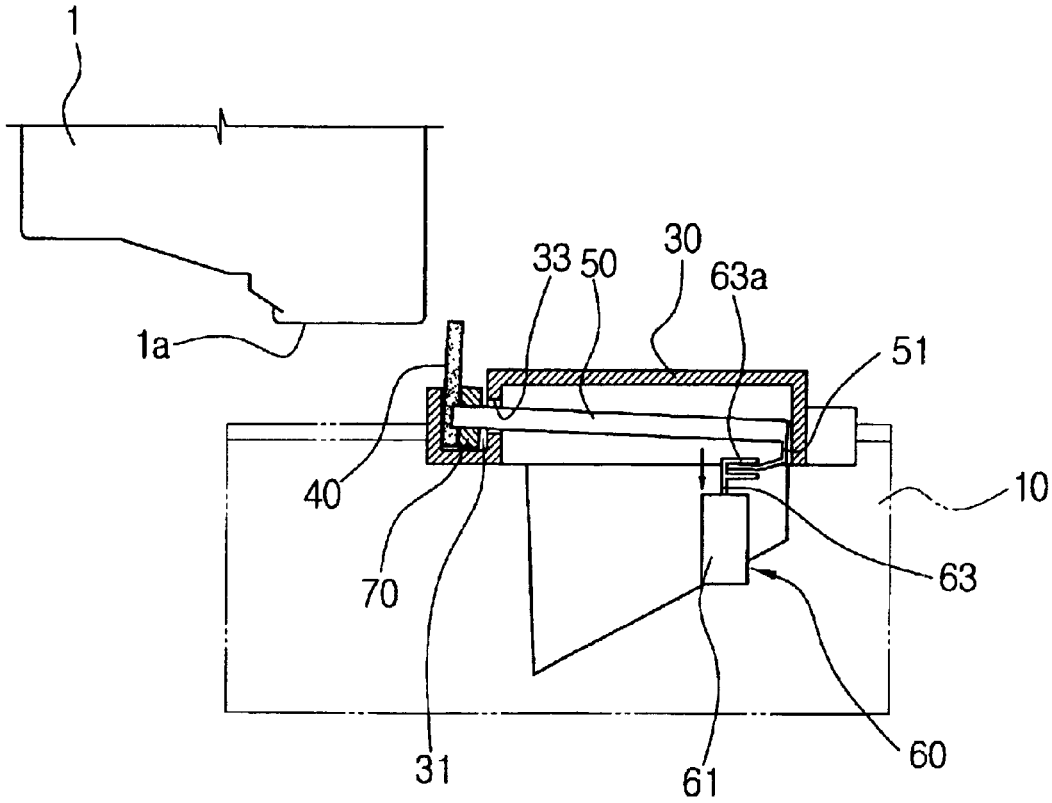
FIGS. 3 and 4 are cross sectional views illustrating an operation of the cleaning apparatus of FIG. 2.
Figure 4:
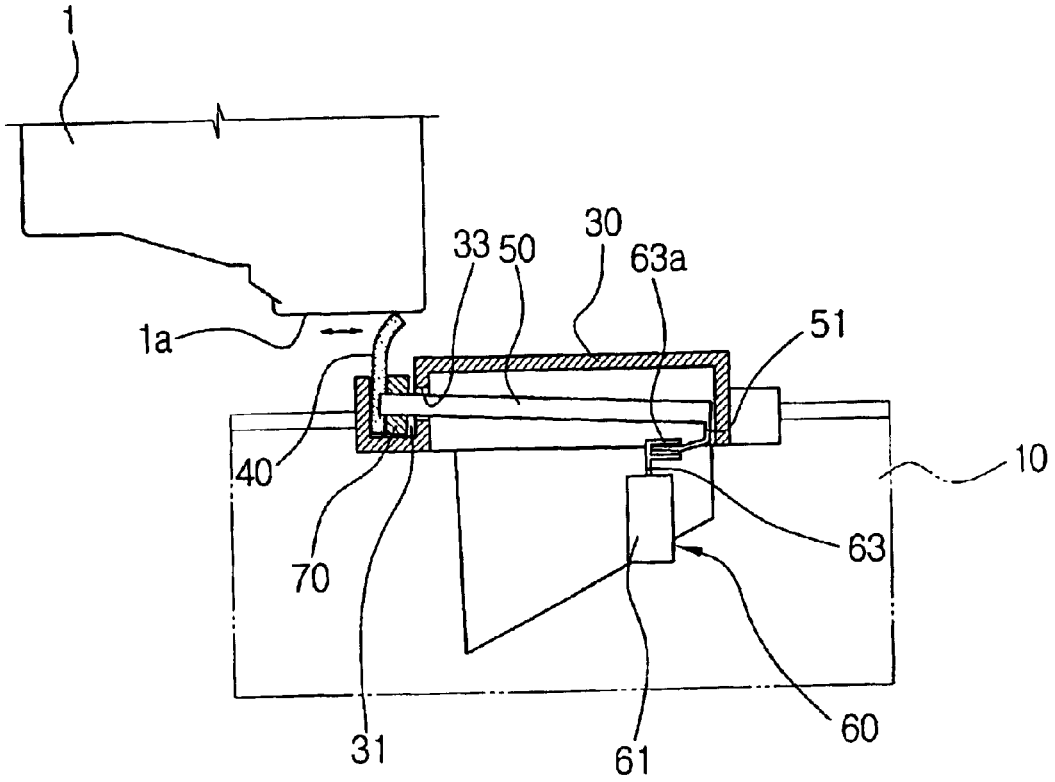

And then, as shown in FIG. 3, the pivot bar 50 pivots in the supporting hole 33, so that the one end of the pivot bar 50 is lifted. The wiper holder 70 and wiper 40 which are supported by the one end of the pivot bar 50 are lifted to a desired height, thereby compensating for a height of the carriage 1 corresponding to the desired distance of the print head 1*a*. Accordingly, the printer head 1*a* is overlapped with the wiper by the predetermined height R. In this state, if the movable plate 30 is slidably moved left and right, the wiper 40 is deformed as much as the wiper 40 overlaps the print head 1*a* to clean the print head 1*a*, as shown in FIG. 4. As the print head is always cleaned appropriately, contamination of the print head and degradation of a print quality are prevented.

Figure 5:
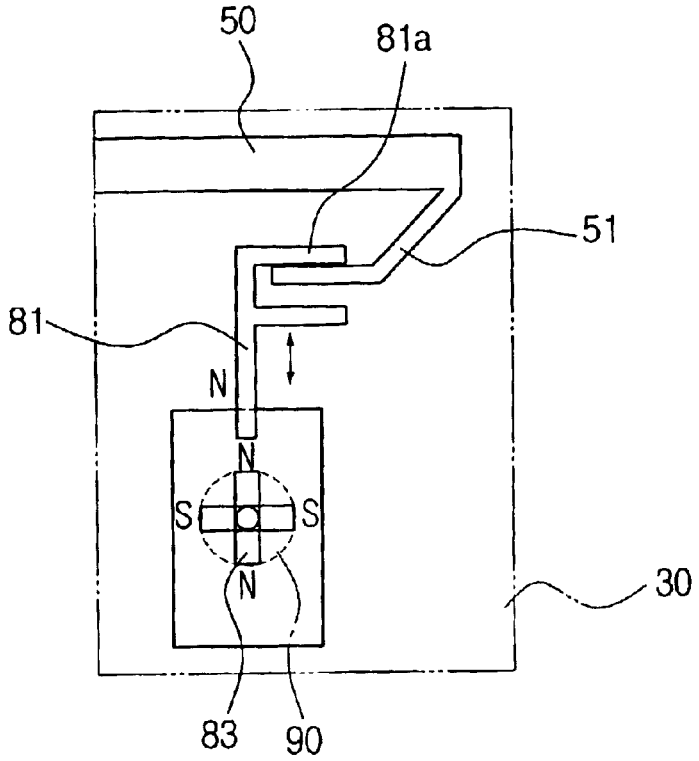
FIG. 5 is a schematic view illustrating a major part of a cleaning apparatus of a print head in an ink jet printer according to another embodiment of the present invention.
Figure 6:
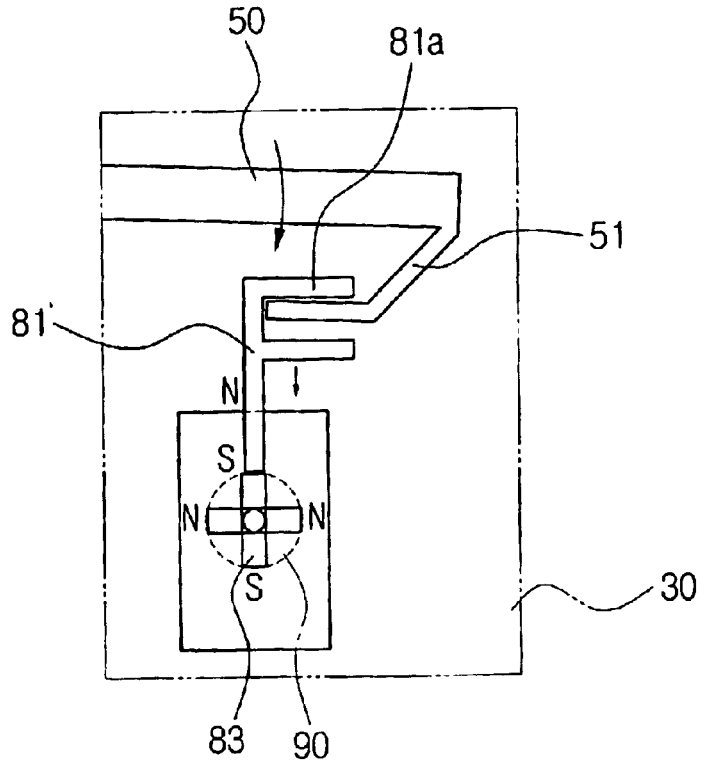
FIG. 6 is a schematic view illustrating an operation of the cleaning apparatus of FIG. 5.

FIG. 5 shows a schematic view of another embodiment of the driving mechanism. The driving mechanism of FIG. 5 includes a magnet member 81 having a desired shape and a positioning electromagnet 83 installed adjacent to the magnet member 81. The magnet member 81 has an interfering part 81 a engaged with the engaging hook 51 of the pivot bar 50. The magnet member 81 is formed on the movable plate 30 in such a way that the magnet member 81 can be lifted up and down in a state that the engaging hook 51 is engaged with the interfering part 81*a*.

The electromagnet 83 is disposed under the magnet member 81 and may be a crisscross electromagnet with a south pole and a north pole being alternated with each other at a right angle. The criss-cross electromagnet 83 is rotated at a desired angle around its center by a rotating motor 90.

As shown in FIG. 5, if the north pole of the magnet member 81 faces the north pole of the electromagnet 83, the magnet member 81 is positioned on a lifted location by a repulsive force. By contrast, if the electromagnet 83 is rotated at a right angle, the south pole of the electromagnet 83 faces the north pole of the magnet member 81, so that the magnet member 81 is lowered by an attractive force generated between the magnet member 81 and the electromagnet 83. The pivot bar 50 is lowered by the magnet member 81, so that the desired height of the wiper which is supported by the one end of the pivot bar 50 may be adjusted with respect to the print head 1*a*. In this case also, the head gap between the print head 1*a* and the recording sheet is measured, and the position of the carriage 1 is lifted in accordance with the measured head gap, and the electromagnet 83 is controlled so that a relative position between the wiper 40 and the print head 1*a* is changed in response to a measured signal corresponding to the measured head gap.

With the construction of the cleaning apparatus of the print head in the ink jet printer, when the head gap between the print head and the thick recording sheet is manually or automatically adjusted to print the image on the thick recording sheet, the overlapping of the wiper relative to the print head is automatically adjusted to maintain the predetermined height between the print head and the wiper at a constant level, and as a result, cleaning of the print head is always performed appropriately.

Although a few preferred embodiments of the present invention have been shown and described, it would be appreciated by those skilled in the art that changes may be made in this embodiment without departing from the principles and spirit of the invention, the scope of which is defined in the claims and their equivalents.

What is claimed is:

1. An apparatus for cleaning a print head disposed on a carriage in an ink jet printer, the apparatus comprising:

a movable plate reciprocally sliding under the carriage;

a wiper supported by the movable plate to clean the print head while being overlapped with the print head by an overlap during a reciprocal movement of the movable plate;

a pivot bar pivotally mounted on the movable plate and having one end supporting the wiper; and a driving unit adjusting the overlap of the wiper with respect to the print head by driving the pivot bar such that the overlap of the wiper relative to the print head is maintained constant.

2. The apparatus as claimed in claim 1, wherein the driving unit comprises:

a magnet member movably formed on the movable plate to move with respect to the movable plate and having one end engaged with the pivot bar; and an electromagnet installed adjacent to the magnet member to control the magnet member to move to a selected location by selectively generating a repulsive force and an attractive force with the magnet member.

3. The apparatus as claimed in claim 2, wherein the ink jet printer comprises a rotating motor, and the electromagnet is a criss-cross electromagnet with a south pole and a north pole being alternated with each other at a right angle, the criss-cross electromagnet being selectively rotated at a predetermined angle around a center by the rotating motor.

4. The apparatus as claimed in claim 1, wherein the driving unit comprises:

a solenoid disposed on the movable plate to be cooperated with another end of the pivot bar and to control the pivot bar to pivot on the movable plate.

5. The apparatus as claimed in claim 1, wherein the pivot bar comprises:

a wiper holder formed on the one end of the pivot bar and supporting the wiper such that the wiper is moved with respect to the print head by the one end of the pivot bar.

6. An apparatus for cleaning a print head movably mounted on a carriage in an ink jet printer, comprising:

a movable plate;

a wiper movably mounted on the movable plate to clean the print head when the movable plate moves with respect to the print head; and a control unit controlling the wiper with respect to the movable plate to adjust an overlap between the print head and the wiper, wherein the control unit moves the wiper to maintain the overlap constant when the print head moves with respect to the carriage.

7. An apparatus for cleaning a print head movably mounted on a carriage in an ink jet printer, comprising:

a movable plate;

a wiper movably mounted on the movable plate to clean the print head when the movable plate moves with respect to the print head; and a control unit controlling the wiper with respect to the movable plate to adjust an overlap between the print head and the wiper, wherein the ink jet printer comprises a paper feeding path and a head gap formed between the printer head and the paper feeding path and controls the print head to move with respect to the carriage to adjust the head gap, and the control unit adjusts the overlap in response to the adjusted head gap.

8. An apparatus for cleaning a print head movably mounted on a carriage in an ink jet printer, comprising:

a movable plate;

a wiper movably mounted on the movable plate to clean the print head when the movable plate moves with respect to the print head; and a control unit controlling the wiper with respect to the movable plate to adjust an overlap between the print head and the wiper, wherein the ink jet printer controls the print head to move with respect to the carriage by a distance, and the control unit controls the wiper to adjusts the overlap in response to the controlling of the print head.

9. The apparatus of claim 8, wherein the overlap is adjusted in accordance with an amount of the distance.

10. An apparatus for cleaning a print head movably mounted on a carriage in an ink jet printer, comprising:

a movable plate;

a wiper movably mounted on the movable plate to clean the print head when the movable plate moves with respect to the print head; and a control unit controlling the wiper with respect to the movable plate to adjust an overlap between the print head and the wiper, wherein the control unit automatically adjusts the overlap between the print head and the wiper when the print head moves by a distance with respect to the carriage.

11. An apparatus for cleaning a print head movably mounted on a carriage in an ink jet printer, comprising:

a movable plate;

a wiper movably mounted on the movable plate to clean the print head when the movable plate moves with respect to the print head; and a control unit controlling the wiper with respect to the movable plate to adjust an overlap between the print head and the wiper, wherein the print head moves with respect to the carriage to adjust a head gap between the print head and a feeding path where one of a first recording sheet having a first thickness and a second recording sheet having a second thickness different from the first thickness is supposed to be fed, and the control unit controls the wiper to maintain the overlap constant in response to the adjusted head gap.

12. The apparatus of claim 11, wherein the control unit controls the wiper to adjust the overlap in response to the one of the first recording sheet and the second recording sheet.

13. The apparatus of claim 11, wherein the control unit controls the wiper in response to a difference between the first thickness and the second thickness.

14. The apparatus of claim 11, wherein the print head moves by a distance corresponding to a difference between the first thickness and the second thickness, and the controlling unit controls the wiper in accordance with the distance.

15. The apparatus of claim 11, wherein the print head moves with respect to the wiper, and the control unit controls the wiper to move toward and away from the print head to maintain the overlap constant.

16. An apparatus for cleaning a print head movably mounted on a carriage in an ink jet printer, comprising:

a movable plate;

a wiper movably mounted on the movable plate to clean the print head when the movable plate moves with respect to the print head; and a control unit controlling the wiper with respect to the movable plate to adjust an overlap between the print head and the wiper, wherein the overlap is changed when the print head moves with respect to the carriage, and the control unit controls the wiper to adjust the changed overlap.

17. An apparatus for cleaning a print head movably mounted on a carriage in an ink jet printer, comprising:

a movable plate;

a wiper movably mounted on the movable plate to clean the print head when the movable plate moves with respect to the print head; and a control unit controlling the wiper with respect to the movable plate to adjust an overlap between the print head and the wiper, wherein the control unit comprises a solenoid mounted on the movable plate to control the wiper to move with respect to the print head so as to adjust the overlap.

18. An apparatus for cleaning a print head movably mounted on a carriage in an ink jet printer, comprising:

a movable plate;

a wiper movably mounted on the movable plate to clean the print head when the movable plate moves with respect to the print head; and a control unit controlling the wiper with respect to the movable plate to adjust an overlap between the print head and the wiper, wherein the control unit comprises a pivot bar disposed on the movable plate to be coupled to the wiper, a magnet mounted on the pivot bar, and an electro-magnet selectively generating an attracting force and a repulsing force with the magnet of the pivot bar to control the wiper to move with respect to the print head so as to adjust the overlap.

19. An apparatus for cleaning a print head movably mounted on a carriage in an ink jet printer, comprising:

a movable plate;

a wiper movable mounted on the movable plate to clean the print head when the movable plate moves with respect to the print head; and a control unit controlling the wiper with respect to the movable plate to adjust an overlap between the print head and the wiper, wherein the movable plate comprises a supporting member, and the control unit comprises a motor and a pivot bar having a first end coupled to the wiper, a second end coupled to the motor, and a third end disposed between the first end and the second end to be supported by the supporting member, the motor moving the pivot bar.

20. The apparatus of claim 19, wherein the pivot bar is a seesaw moving with respect to the supporting member.

21. The apparatus of claim 19, wherein the movable plate comprises a first portion accommodating the wiper and the first end of the pivot bar and a second groove disposed opposite to the first portion with respect to the supporting member to accommodate the second end of the pivot bar, the motor controlling the second end of the pivot bar.

22. The apparatus of claim 19, wherein the supporting member comprises a hole, and the pivot bar is inserted into the hole of the supporting member.

23. The apparatus of claim 19, wherein the motor is one of a solenoid and a rotating motor.

* * * * *